US005561262A

United States Patent [19]

Bartels et al.

[11] Patent Number: 5,561,262

[45] Date of Patent: Oct. 1, 1996

[54] SPIN-STABILIZED CARRIER PROJECTILE

[75] Inventors: Volker Bartels, Düsseldorf; Klaus D. Karius, Jüchen, both of Germany

[73] Assignee: Rheinmetall Industrie GmbH, Ratingen, Germany

[21] Appl. No.: 516,618

[22] Filed: Aug. 18, 1995

[30] Foreign Application Priority Data

Aug. 18, 1994 [DE] Germany ..... 44 29 292.9

[51] Int. Cl.[6] ..... F42B 12/58

[52] U.S. Cl. ..... 102/489; 102/357

[58] Field of Search ..... 102/340, 342, 102/351, 357, 393, 489, 505; 244/3.1, 3.23

[56] References Cited

U.S. PATENT DOCUMENTS

| | | | |
|---|---|---|---|
| 2,454,281 | 11/1948 | Hicks | 102/489 |
| 4,204,413 | 5/1980 | Miller | 64/30 E |
| 4,232,607 | 11/1990 | Benson | 102/489 |
| 4,645,247 | 2/1987 | Ward | 285/382.1 |
| 4,771,696 | 9/1988 | Smolnik | 102/489 |
| 4,807,533 | 2/1989 | von Entress-Fursteneck | 102/489 |
| 4,920,887 | 5/1990 | Frehaut et al. | 102/489 |
| 5,210,372 | 11/1993 | Tripptrap et al. | 102/489 |
| 5,233,127 | 8/1993 | Sauvestre et al. | 102/489 |
| 5,253,947 | 10/1993 | Petrzelka et al. | 403/274 |
| 5,257,558 | 11/1993 | Farzin-Nia et al. | 81/418 |
| 5,317,975 | 6/1994 | Sauvestre et al. | 102/489 |
| 5,398,615 | 3/1995 | Johnsson et al. | 102/489 |
| 5,473,988 | 12/1995 | Dion | 102/489 |

FOREIGN PATENT DOCUMENTS

| | | |
|---|---|---|
| 0224154 | 6/1987 | European Pat. Off. . |
| 0395456 | 10/1990 | European Pat. Off. . |
| 0434505 | 6/1991 | European Pat. Off. . |
| 0521436 | 1/1993 | European Pat. Off. . |
| 3841908 | 7/1990 | Germany . |

*Primary Examiner*—Harold J. Tudor
*Attorney, Agent, or Firm*—Spencer & Frank

[57] ABSTRACT

A projectile assembly includes a spin-stabilized carrier projectile having a carrier casing and a base at one end of the casing; and a sub-ammunition assembly composed of a plurality of sub-ammunition components stacked to form a column. One of the components is an end component adjoining the base. A component surface of the end component is oriented towards and is in engagement with the base surface. At least two of the components are sub-ammunition projectiles. An arrangement maintains a frictional lock between the base surface and the component surface of the end component. According to the arrangement a portion of the base surface and a portion of the component surface of the end component have high coefficients of friction.

14 Claims, 2 Drawing Sheets

SPIN-STABILIZED CARRIER PROJECTILE

BACKGROUND OF THE INVENTION

This invention relates to a spin-stabilized carrier projectile which has a projectile base and which accommodates at least two sub-ammunition projectiles stacked on one another in a column-like configuration.

Upon firing of carrier projectiles of the above-outlined type frequently difficulties are encountered in the transmission of spin from the carrier projectile to the sub-ammunition projectiles. Such difficulties may result in an undesired slippage of the sub-ammunition projectiles, particularly in the region of the projectile base. This occurrence interferes with the correct functional progression following the ejection of the sub-ammunition projectiles from the casing of the carrier projectile. Also, an unstable flight behavior of the carrier projectile may result.

German Offenlegungsschrift (application published without examination) 38 41 908 discloses a spins-stabilized bomblet carrier projectile in which lateral filler parts are provided for the securement of and spin transmission to the bomblets. The filler parts have wedge-shaped carrier dogs which extend into corresponding grooves of the carrier casing in a form-fitting manner and thus ensure a spin transmission from the carrier projectile to the bomblet projectiles.

It is a disadvantage of form-fitting connections of the above-outlined type that the manufacturing outlay for making the filler components as well as for providing the grooves in the outer wall is high and further, the filler components require substantial space to the detriment of the payload.

SUMMARY OF THE INVENTION

It is an object of the invention to provide an improved spin-stabilized carrier projectile which has a projectile base and accommodates at least two sub-ammunition projectiles, which is simple to manufacture and nevertheless ensures a secure spin transmission from the carrier projectile to the sub-ammunition projectiles.

This object and others to become apparent as the specification progresses, are accomplished by the invention, according to which, briefly stated, the projectile assembly includes a spin-stabilized carrier projectile having a carrier casing and a base at one end of the casing; and a sub-ammunition assembly composed of a plurality of sub-ammunition ammunition components stacked to form a column. One of the components is an end component adjoining the base. A component surface of the end component is oriented towards and is in engagement with the base surface. At least two of the components are sub-ammunition projectiles. An arrangement maintains a frictional lock between the base surface and the component surface of the end component. According to the arrangement a portion of the base surface and a portion of the component surface of the end component have high coefficients of friction.

It is the basic principle of the invention to ensure the spin transmission from the projectile base to the sub-ammunition projectiles by means of a frictional connection. For this purpose, the facing surfaces of the projectile base and that of the sub-ammunition projectile situated adjacent the projectile base as well as the facing surfaces of the sub-ammunition projectiles are at least in part provided with a surface having a high coefficient of friction. Such a surface may be constituted by a coating of an appropriate material. Tungsten carbide was found to be a particularly advantageous high-friction material for this purpose.

In case between the projectile base and a sub-ammunition projectile or between two adjoining sub-ammunition projectiles spacers are arranged, then these too, are provided with a high-friction surface to engage the high-friction surface of the adjoining sub-ammunition projectile or carrier projectile base.

DESCRIPTION OF THE PREFERRED EMBODIMENT

Figure 1:
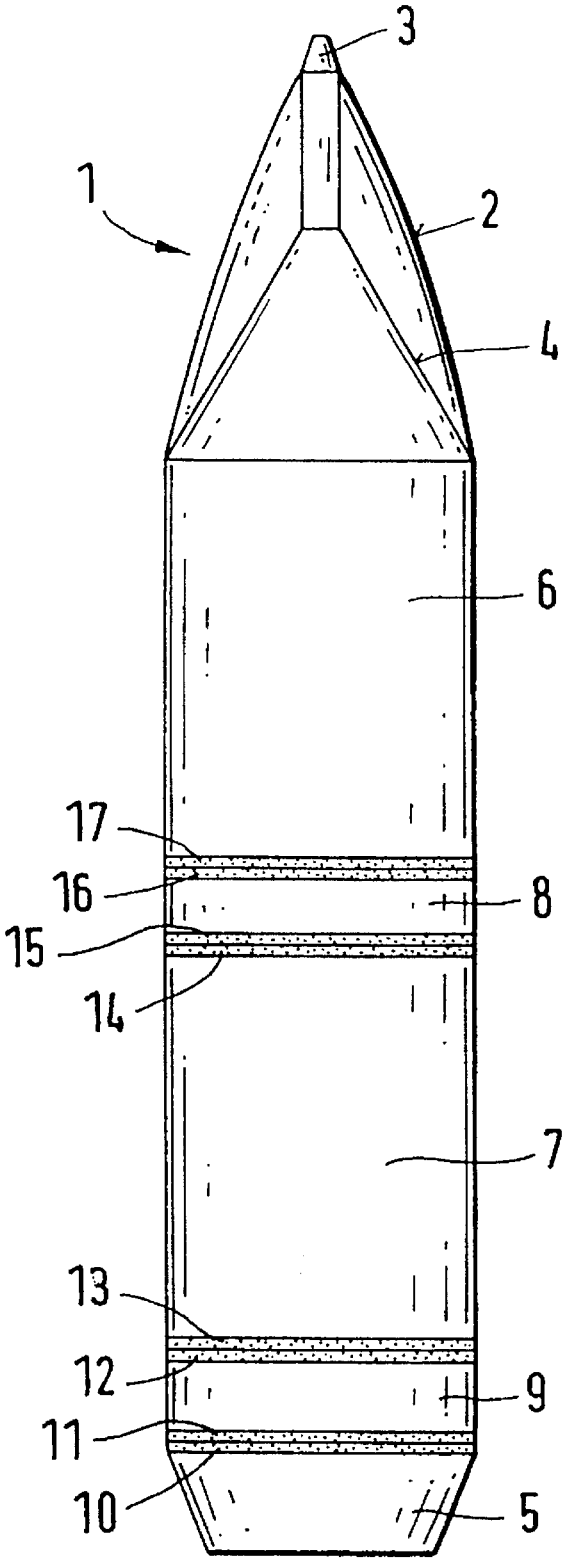
FIG. 1 is a schematic elevational view of a preferred embodiment of the invention.

Turning to FIG. 1, a carrier projectile generally designated at 1 is essentially composed of a carrier projectile casing 2, a fuse 3, an ejection unit 4 and a projectile base 5.

In the carrier projectile casing 2 two sub-ammunition projectiles 6 and 7 are arranged. Between the sub-ammunition projectiles 6 and 7 as well as between the carrier projectile base 5 and the sub-ammunition projectile 7 respective annular spacer parts 8 and 9 are provided, for example, for the purpose of length adaptation of already existing sub-ammunition projectiles to a new carrier projectile casing.

According to the invention, the facing surfaces of the projectile base 5 and the spacer 9 as well as the spacer 9 and the adjoining sub-ammunition projectile 7 are provided with respective tungsten carbide layers 10–13. The facing surfaces of the sub-ammunition projectiles 6 and 7 and the interposed spacer 8 too, are provided with corresponding tungsten carbide layers 14–17. By virtue of appropriate longitudinal dimensioning of the sub-ammunition assembly column) formed of the sub-ammunition components, namely the sub-ammunition projectiles 6, 7 and the spacers 8, 9, upon closing the carrier casing 2, an axial compression force is applied and maintained on the column so that, by virtue of the tungsten carbide layers 10–17 which are in engagement with one another, a frictional connection is obtained between the sub-ammunition components 6–9.

Figure 2A:
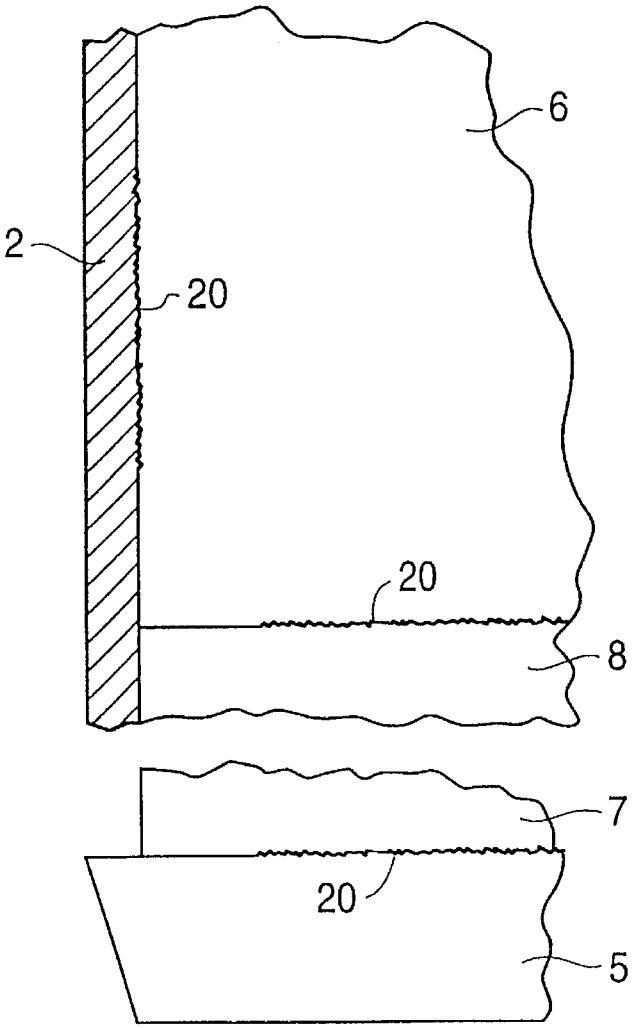
FIG. 2*a* is a schematic elevational view of another preferred embodiment of the invention.
Figure 2:
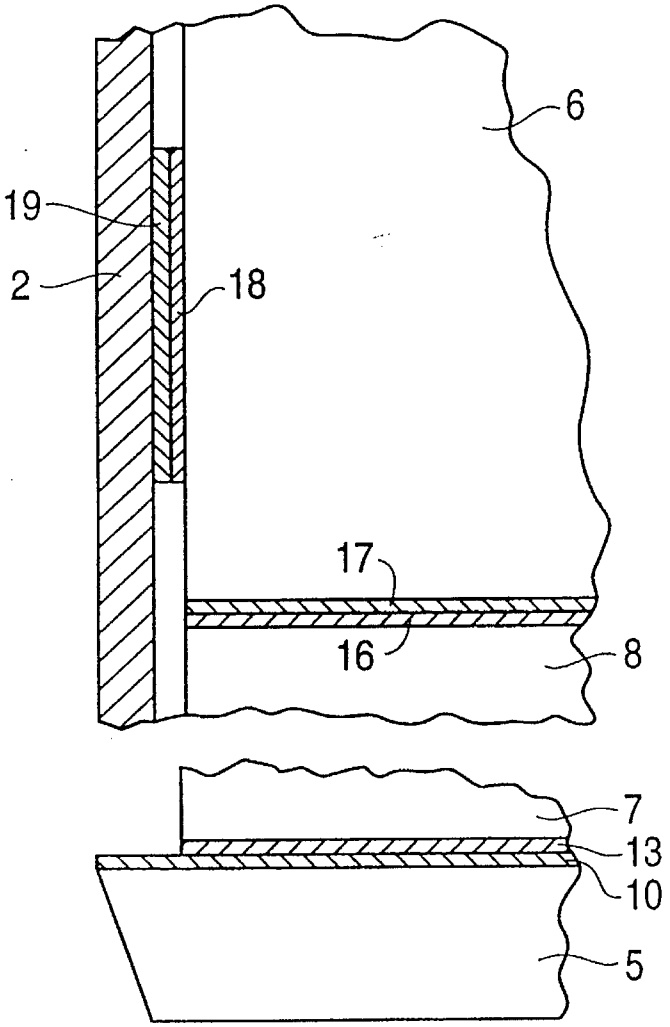
FIG. 2 is a schematic fragmentary sectional view of a variant of FIG. 1.

Turning to FIG. 2, in case it is found that by means of the surface treatment as described above, a satisfactory frictional lock cannot be achieved between the ammunition components 5, 9, 7, 8 and 6, the sub-ammunition projectiles 6, 7 and if needed, the spacers 8 and 9 may also have additional annular frictional locking zones on their sides facing the carrier projectile casing 2. Such an annular frictional zone for the sub-ammunition projectile 6 is designated at 18. An annular frictional surface zone 19 formed on the inner face of the carrier casing 2 may be aligned with the surface zone 18. FIG. 2 further shows an arrangement where the sub-ammunition projectile 7 directly adjoins the base 5.

It will be understood that the invention is not limited to the above-described preferred embodiment. Thus, instead of tungsten carbide, another material may be used which has a high coefficient of friction, or the surfaces may be roughened by sandblasting as indicated at 20 in FIG. 2*a*.

It is noted that for the sake of clarity of illustration the dimensional relationships are not drawn to scale in the Figures.

It will be understood that the above description of the present invention is susceptible to various modifications, changes and adaptations, and the same are intended to be comprehended within the meaning and range of equivalents of the appended claims.

What is claimed is:

1. A projectile assembly comprising (a) a spin-stabilized carrier projectile having a carrier casing and a base at one end of the casing; said base having a base surface;

(b) a sub-ammunition assembly composed of a plurality of sub-ammunition components stacked to form a column; one of said components being an end component adjoining said base; each of said components having a component surface; the component surface of said end component being oriented towards and being in engagement with said base surface; at least two of said components being sub-ammunition projectiles; and (c) friction means for maintaining a frictional lock between said base surface and said component surface of said end component; said friction means including a tungsten carbide coating provided on said base surface and said component surface.

2. The projectile assembly as defined in claim 1, wherein said end component is one of said sub-ammunition projectiles.

3. The projectile assembly as defined in claim 1, wherein component surfaces of adjoining said components face and engage one another; said friction means including tungsten carbide-coated portions of the facing and mutually engaging component surfaces.

4. The projectile assembly as defined in claim 1, wherein said carrier casing has a lateral casing surface; the component surface of at least one of said components facing and engaging said lateral casing surface; said friction means further including a tungsten carbide-coated portion of said lateral casing surface and said engaging component surface of said one component.

5. The projectile assembly as defined in claim 1, wherein at least one of said components is a spacer member.

6. The projectile assembly as defined in claim 5, wherein said end component is a spacer member.

7. A projectile assembly comprising (a) a spin-stabilized carrier projectile having a carrier casing and a base at one end of the casing; said base having a base surface;

(b) a sub-ammunition assembly composed of a plurality of sub-ammunition components stacked to form a column; one of said components being an end component adjoining said base; each of said components having a component surface; the component surface of said end component being oriented towards and being in engagement with said base surface; at least two of said components being sub-ammunition projectiles; and (c) friction means for maintaining a frictional lock between said base surface and said component surface of said end component; said friction means including a sandblasted portion of said base surface and said component surface.

8. The projectile assembly as defined in claim 7, wherein said end component is one of said sub-ammunition projectiles.

9. The projectile assembly as defined in claim 7, wherein component surfaces of adjoining said components face and engage one another; said friction means including sandblasted portions of the facing and mutually engaging component surfaces.

10. The projectile assembly as defined in claim 7, wherein said carrier casing has a lateral casing surface; the component surface of at least one of said components facing and engaging said lateral casing surface; said friction means further including a sandblasted portion of said lateral casing surface and said engaging component surface of said one component.

11. The projectile assembly as defined in claim 7, wherein at least one of said components is a spacer member.

12. The projectile assembly as defined in claim 11, wherein said end component is a spacer member.

13. A projectile assembly comprising (a) a spin-stabilized carrier projectile having a carrier casing and a base at one end of the casing; said carrier casing having a lateral casing surface;

(b) a sub-ammunition assembly composed of a plurality of sub-ammunition components stacked to form a column; each of said components having a component surface; at least two of said components being sub-ammunition projectiles; the component surface of at least one of said components facing and engaging said lateral casing surface; and (c) friction means for maintaining a frictional lock between said lateral casing surface and said component surface of said one component; said friction means including a tungsten carbide coating provided on said lateral casing surface and said component surface.

14. A projectile assembly comprising (a) a spin-stabilized carrier projectile having a carrier casing and a base at one end of the casing; said carrier casing having a lateral casing surface;

(b) a sub-ammunition assembly composed of a plurality of sub-ammunition components stacked to form a column; each of said components having a component surface; at least two of said components being sub-ammunition projectiles; the component surface of at least one of said components facing and engaging said lateral casing surface; and (c) friction means for maintaining a frictional lock between said lateral casing surface and said component surface of said one component; said friction means including a sandblasted portion of said lateral casing surface and said component surface.

* * * * *